United States Patent [19]

Goins

[11] Patent Number: 4,755,061

[45] Date of Patent: Jul. 5, 1988

[54] PROPORTIONAL FEEDER FOR PARTICULATE SOLIDS

[75] Inventor: Robert R. Goins, Bartlesville, Okla.

[73] Assignee: Phillips Petroleum Company, Bartlesville, Okla.

[21] Appl. No.: 116,310

[22] Filed: Nov. 4, 1987

[51] Int. Cl.[4] ..... B01F 5/00; B01F 5/24; B01F 15/02

[52] U.S. Cl. ..... 366/76; 193/27; 193/30; 222/134; 222/145; 239/424; 366/178; 366/186; 366/192; 366/341; 414/295

[58] Field of Search ..... 366/76, 77, 96, 136, 366/137, 151, 152, 177, 178, 181, 182, 184, 186, 189, 192, 341, 349; 193/3, 27, 30, 31 R; 222/132, 134, 145, 199, 200, 459; 239/423, 424; 414/139, 291, 295

[56] References Cited

U.S. PATENT DOCUMENTS

| | | | |
|---|---|---|---|
| 189,046 | 4/1877 | King . | |
| 1,229,224 | 6/1917 | Carpenter et al. | 193/30 |
| 2,741,796 | 4/1956 | King . | |
| 3,216,629 | 11/1965 | Goins | 222/459 |
| 3,456,922 | 7/1969 | Goins . | |
| 3,575,321 | 4/1971 | Fisher | 222/145 |
| 3,858,733 | 1/1978 | Morioka et al. . | |
| 3,926,290 | 12/1975 | Isojima et al. | 193/27 |
| 4,068,828 | 1/1978 | Goins | 366/136 |
| 4,281,776 | 8/1981 | Goins | 222/132 |
| 4,314,787 | 2/1982 | Kwasnik et al. | 193/30 X |
| 4,358,207 | 11/1982 | Roth | 366/336 |
| 4,472,064 | 9/1984 | Goins | 366/134 |
| 4,518,260 | 5/1985 | Goins | 366/341 X |
| 4,538,921 | 9/1985 | Kennedy | 366/178 |
| 4,600,151 | 7/1986 | Bradley | 239/424 X |
| 4,662,759 | 5/1987 | Leibee et al. | 366/178 |

*Primary Examiner*—Timothy F. Simone
*Attorney, Agent, or Firm*—Paul S. Chirgott

[57] ABSTRACT

In the mixing of two or more particulate solid feeds in proportional ratios in which the unmixed solids are fed from separate bin receivers into a common mixture bin receiver having a generally vertical section, the present invention comprises an improved feeder in which a feeder means extends below the level of the solids in the common mixture bin. The improved feeder means of this invention comprises at least two nested conduits of differing horizontal cross-sectional areas. One or more of these nested conduits may be raised (or lowered) by an adjusting means to engage a conduit having a greater (or lesser) horizontal cross-sectional area enabling the proportions of particulate solids being fed to be changed as desired.

11 Claims, 3 Drawing Sheets

PROPORTIONAL FEEDER FOR PARTICULATE SOLIDS

FIELD OF THE INVENTION

This invention relates to an apparatus for mixing and/or feeding particulate solids into a vessel.

BACKGROUND

Many applications for plastic materials require the use of colorants. Such colorants can be dyes, organic pigments, and inorganic pigments. Colorants can be in the form of dry powders or they can be concentrates with a high loading of color in the polymer used.

Of the methods used to color a plastic material, one of the simplest is barrel blending, wherein a measured portion of colorant is admixed by tumbling, with a measured portion of natural (uncolored) plastic material. Barrel blending, however, is not well adapted to large volume applications. Some commercial applications generally utilize large tank blenders, wherein measured portions of materials to be blended are placed in the tank blender and blended material is withdrawn from the tank when blending is completed. Where blending is performed in batch functions, the blended materials must be stored until they are utilized by the processing machinery (i.e. molding, spinning, etc.). This, however, results in some problems due to the blended material separating prior to its use. One method of resolving this problem is by direct proportionate feed from a storage facility to the processing machinery.

One example of direct proportionate feeding is the use of a weigh belt feeder system. The simplest such system involves a natural and a color concentrate pellet storage hopper pellet storage hopper with each hopper having its own weigh belt conveyor. The two conveyors discharge into a common receptacle, as for example, the feed hopper of an extruder. While such systems offer some advantages over batch handling systems, they are, nevertheless, not without drawbacks. For example, they can be expensive to maintain. Moreover, since this method of proportionate feeding is dependent upon precise measuring and feeding devices, calibration problems often arise.

Historically, as customer demands for better control of color level have increased, more sophisticated and expensive control equipment has been employed, rather than seeking out less expensive, less complicated equipment. It is therefore an object of this invention to provide an improved apparatus for the proportionate feeding of particulate solids.

Other objects, aspects and advantages of the present invention will become apparent to those skilled in the art upon reading the following detailed description when considered in connection with the accompanying drawings and the appended claims.

SUMMARY OF THE INVENTION

In the mixing of two or more particulate solid feeds in proportional ratios in which the unmixed solids are fed from separate bin receivers into a common mixture bin receiver having a generally vertical section, the present invention comprises an improved feeder in which a feeder means extends below the level of the solids in the common mixture bin. The feeder means comprises at least two nested conduits of differing horizontal cross-sectional areas. One or more of these nested conduits may be raised (or lowered) by an adjusting means to engage a conduit having a greater (or lesser) horizontal cross-sectional area enabling the proportions of particulate solids being fed to be changed as desired.

BRIEF DESCRIPTION OF THE DRAWINGS

A more complete appreciation of the invention and many attendant advantages thereof will be readily obtained as the same becomes better understood by reference to the following detailed description when considered in connection with the accompanying figures briefly described below.

DETAILED DESCRIPTION OF THE INVENTION

Figure 1:
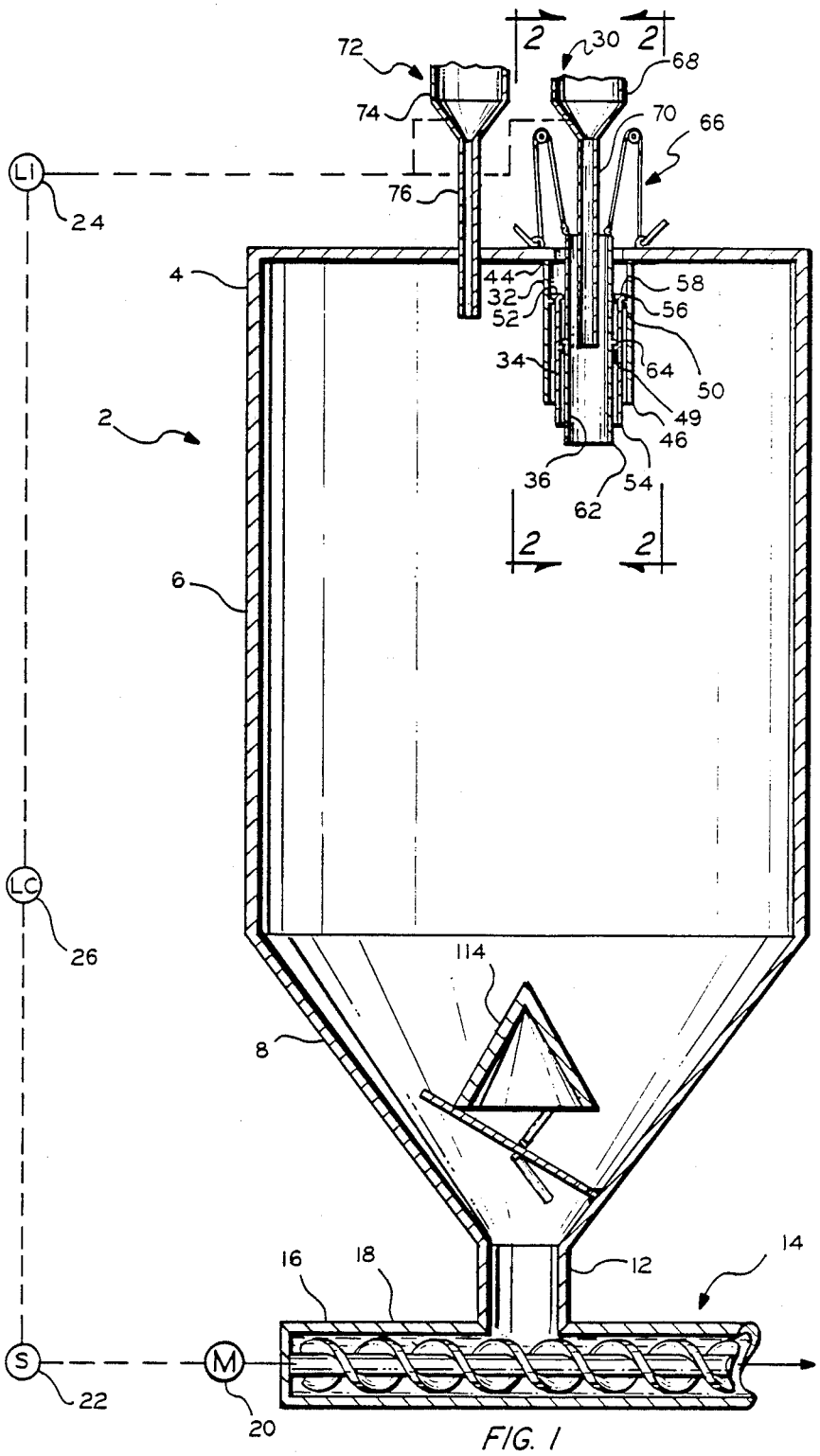
FIG. 1 is a cross-sectional view of a proportional feeder of this invention.

In general, FIG. 1 illustrates one embodiment of a proportional feeder of this invention. Specifically, the embodiment illustrated in FIG. 1 is that of a proportional feeder comprising a vessel 2 having an upper end portion 4, a medial portion 6, and a lower end portion 8. Upper end portion 4 and medial portion 6 of vessel 2 define a generally vertical cavity.

In FIG. 1, the lower end portion 8 of vessel 2 generally defines a converging cavity which opens into outlet means 12. Outlet means 12 can open directly into any suitable location. Examples of such suitable locations include, but are not limited to, extruders, feed hoppers of processing machinery, pellet blenders, weigh belt conveyors, air conveyors and/or, as illustrated in FIG. 1, a flow control means 14.

If it is desired to disperse the contents of vessel 2 into a flow control means, any suitable means can be utilized. In the embodiment illustrated in FIG. 1, the employed flow control means is a screw conveyor 14 comprising a screw conveyor housing 16 and a screw 18. Screw 18 can be rotated by a suitable means. In FIG. 1, screw 18 is rotated by motor 20 whose speed of rotation is set by speed controller 22. The setting of speed controller 22 can be adjusted either manually or automatically. In FIG. 1, speed controller 22 is adjusted automatically.

Vessel 2 further comprises a first inlet means 30 opening through the upper end portion 4, and extending into the medial portion 6, of vessel 2. This first inlet means of this invention comprises at least two nested conduits. In the embodiment illustrated in FIG. 1, first inlet means 30 comprises three generally vertically oriented, nested conduit elements 32, 34, and 36 of progressively smaller horizontal cross-sectional areas.

Conduit 32 has an upper end 44 and a lower end 46. The upper end 44 of conduit 32 is permanently affixed to the inside wall of the upper end portion 4 of vessel 2. The upper end 44 of conduit 32 further comprises a first inwardly extending circumferential rib 48. Conduit 32 further comprises a second inwardly extending circumferential rib 50 located between its upper end 44 and its lower end 46.

Conduit 34 also has an upper end 52 and a lower end 54. The upper end 52 of conduit 34 comprises an outwardly extending circumferential rib portion 56 and an inwardly extending circumferential rib portion 58. The outwardly extending circumferential rib portion 56 of conduit 34 is located above the second circumferential rib 50 of conduit 32. Outwardly extending rib portion 56 of conduit 34 is of such a length that, when conduit 34 is in its lowest position, the lower surface of rib portion 56 rests upon the upper surface of rib 50; and, when conduit 34 is in its uppermost position, the upper surface of rib portion 56 abuts the lower surface of rib 48. Conduit 34 further comprises a second inwardly extending circumferential rib 49 located between its upper end 52 and its lower end 54.

Conduit 34 is of such a length that, when in its lowest position, its lower end 54 is below the lower end 46 of conduit 32. When conduit 34 is in its uppermost position, its length is such that its lower end 54 is above the lower end 46 of conduit 32.

Conduit 36, having an upper end 60 and a lower end 62, also comprises an outwardly extending circumferential rib 64 located between its upper end 60 and its lower end 62. Circumferential rib 64 is located below the inwardly extending rib portion 58 of conduit 34. Circumferential rib 64 is of such a length that, when conduit 36 is raised by conduit adjusting means 66 attached to the upper end 60 of conduit 36, the upper surface of rib 64 abuts the lower surface of inwardly extending rib 58; and when conduit 36 is in its lower most position, the lower surface of rib 64 abuts the upper surface of rib 49.

Conduit 36 is of such a length that, when elevated so that the upper surface of rib 64 initially contacts the lower surface of inwardly extending 58, the lower end 62 of conduit 36 is above the lower end 54 of conduit 34, which is below the lower end 46 of conduit 32. If conduit 36 is then elevated to its uppermost position, the upper surface of rib 64 will abut the lower surface of inwardly extending rib portion 58; and, the upper surface of outwardly extending rib portion 56 abuts the lower surface of inwardly extending rib 48. In this uppermost position of conduit 36, its lower end 62 is above the lower end 54 of conduit 34 which is above the lower end 46 of conduit 32.

First inlet means 30 can optionally include a storage vessel 68, which is in direct communication with conduit 70, and opens into conduit 36. The outside dimension of conduit 70 is smaller than the inside dimension of conduit 36 such that conduit 70 can extend into conduit 36. While conduit 70 extends into conduit 36, its length is of such that, when conduit 36 is in its uppermost position, the lower end of conduit 70 is above the lower end 62 of conduit 36.

The embodiment illustrated in FIG. 1 further comprises a second inlet means 72. Optionally, second inlet means 72 can also include a solid storage vessel 74, which is in direct communication with conduit 76. Conduit 76 opens into the upper portion 4 of vessel 2.

The generally vertical cavity formed by upper end portion 4 and medial portion 6 of vessel 2 must be of sufficient length and shape that the downward rate of flow of each material is uniform from the lower end of the lowest conduit of first inlet means through a substantial portion of the generally vertical cavity formed by upper portion 4 and medial portion 6. In general, the length of such a generally vertical cavity depends upon the solid particulate material being fed therethrough. For example, in some instances, the length of such a generally vertical cavity is less than the greatest cross-sectional dimension in any horizontal plane across vessel 2. In most instances, however, to insure uniform flow the length of such generally vertical cavity will be at least equal to the greatest cross-sectional dimension in any horizontal plane across vessel 2.

In the operation of the embodiment illustrated in FIG. 1, solid pellets are supplied to the proportional feeder vessel 2 from optional storage means 68 and 74 vis conduits 70 and 76, respectively. The feeder vessel 2 is supplied with color concentrate pellets through first inlet means 30 and with natural pellets through second inlet means 72.

Before supplying any pellets to feeder vessel 2, the desired ratio of colored pellets to natural pellets which will flow from outlet means 12 is determined by properly positioning the nested conduits of first inlet means 30. Specifically, the ratio of the horizontal cross-sectional area of the lowest conduit to that of the the generally vertical cavity of vessel 2, will generally be proportional to the ratio of colored to natural pellets flowing through outlet means 12.

After properly positioning the nested conduits and while optional flow control means 14 is in the off position, feeder vessel 2 is filled with natural pellets through sccond inlet means 72. Colored concentrate pellets are thereafter supplied to the feeder vessel 2 through first inlet means 30. Flow control means 14 is then activated and the natural and color concentrate pellets uniformly pass downwardly through the feeder by gravity. In order to insure mixing in the proper ratios, the flow rate through outlet means 12 must not be greater than the combined flow rates of particulate material into vessel 2. Furthermore, after the appropriate nested conduit has been positioned to correspond with the desired ratios, the flow of particulate material through both first and second inlet means must be continuous and unrestricted.

As stated earlier, FIG. 1 illustrates an embodiment wherein the flow rate through outlet means 12 is optionally controlled by screw conveyor 14. The speed of rotation of screw 18 is controlled, in FIG. 1, by an optional level controlling device. In this embodiment, the flow of particulate material through outlet means 12, is made to depend upon the level particulate material in optional storage vessels 68 and 72. Specifically, the setting of speed controller 22 is regulated by an optional level indicator 24 and optional level controller 26. Level indicator 24 records the level of particulate material within optional storage vessels 68 and 74. This information is then transmitted to level controller 26. Level controller 26 compares the actual levels of the particulate material within each storage vessel to preset levels. If the actual levels fall below the preset levels, level controller 26 can transmit a signal which will sound an alarm, stop the flow of particulate material through outlet means 12, or adjust the rate at which material is fed through outlet means 12. In FIG. 1, the signal transmitted by level controller 26 regulates speed controller 22 in such a manner as to maintain the actual levels of particulate material within the storage vessels above the preset levels.

The proportional feeder vessel 2 of this invention can have any convenient shape. For example, the feeder can be rectangular, circular, triangular, or the like.

The at least two nested, generally vertically oriented conduit elements, comprising the first inlet means 30, can also have any convenient shape. For example, the nested conduits can be rectangular, circular, triangular or the like.

Further explanation of how the proportion of particulate material entering through first inlet means 30 is altered is illustrated in FIG. 2. As described earlier, conduit 36 has attached to its upper end 60 a conduit adjusting means 66 for applying an upward force while gravity provides a downward force. The ratio of particulate material entering the vessel through first inlet means 30 is determined by the horizontal cross-sectional area of the lowest nested conduit.

Figure 2C:
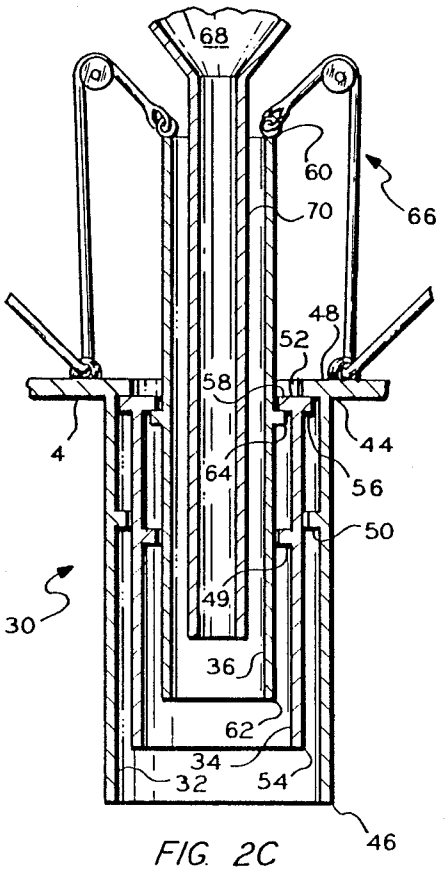
FIGS. 2A, 2B, and 2C are cross-sectional views illustrating one embodiment of the nested conduits of this invention.
Figure 2B:
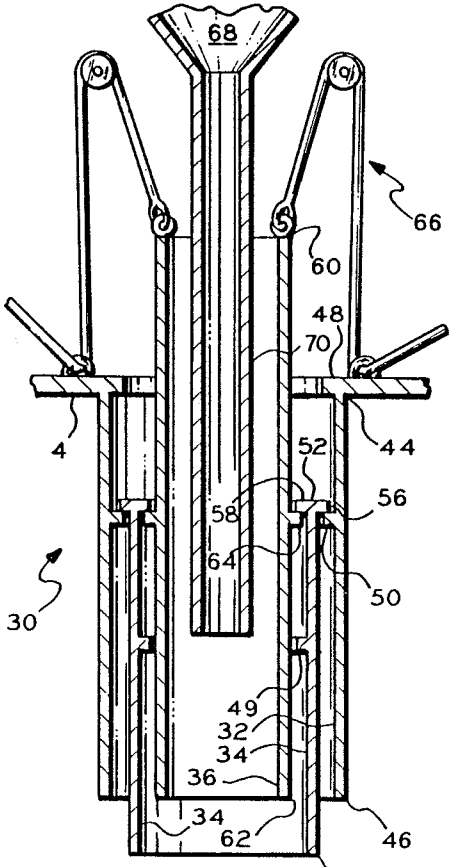
Figure 2A:
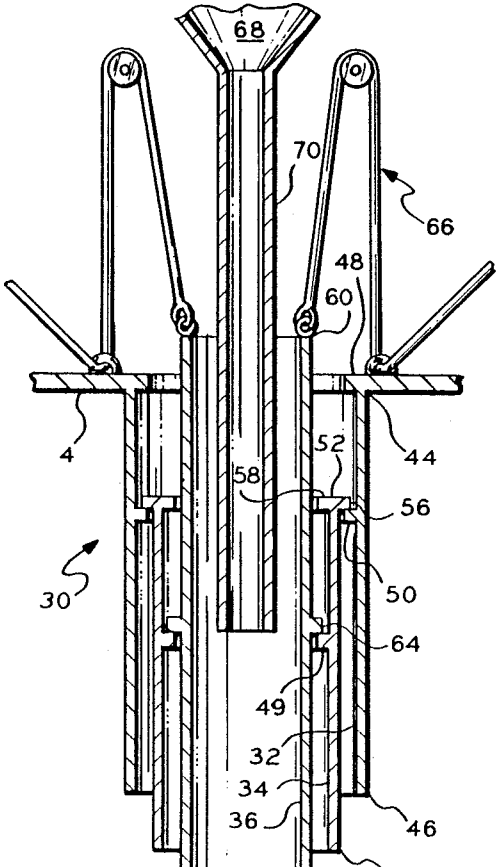

In FIG. 2A the conduit adjusting means 66 is positioned such that conduit 36 is the lowest nested conduit. In this position the lower surface of rib 64 abuts the upper surface of rib 49. As illustrated in FIG. 2, conduit 36 has a horizontal cross-sectional area less than either conduits 34 or 32. Therefore, if the nested conduits are positioned as illustrated in FIG. 2A, assuming a constant flow out through outlet means 12, a lesser amount of particulate material will enter the vessel through first inlet means 30 than would if the nested conduits were positioned as illustrated in either FIG. 2B or FIG. 2C.

In FIG. 2B, the conduit adjusting means 66 has raised conduit 36 so that the upper portion of outwardly extending rib 64 abuts the lower surface of inwardly extending rib portion 58; and, the lower surface of outwardly extending rib portion 56 of conduit 34 is resting upon the upper surface of inwardly extending rib 50. When conduit adjusting means 66 is set in this position, the lowest conduit is conduit 34. As illustrated in FIG. 2, the horizontal cross-sectional area of conduit 34 is greater than that of conduit 36. Therefore, if the nested conduits are positioned as illustrated in FIG. 2B, assuming a constant flow out through outlet means 12, a greater amount of particulate material will enter the vessel through first inlet means 30 than would if the nested conduits were positioned as illustrated in FIG. 2A.

In FIG. 2C, the conduit adjusting means 66 has simultaneously raised conduits 36 and 34 to their uppermost position. In this position the upper surface of outwardly extending rib 64 abuts the lower surface of inwardly extending rib portion 58; and, the upper surface of outwardly extending rib portion 56 abuts the lower surface of inwardly extending rib 48. When the conduit adjusting means 66 has been set to this position, conduit 32 is the lowest nested conduit. As illustrated in FIG. 2, the horizontal cross-sectional area of conduit 32 is greater than the horizontal cross-sectional area of either conduits 34 or 36. Therefore, if the nested conduits are positioned as illustrated in FIG. 2C, assuming a constant flow out through outlet means 12, a greater amount of particulate material will enter the vessel through first inlet means 30 than would if the nested conduits were positioned as illustrated in either FIG. 2A or FIG. 2B.

An alternative means of altering the proportion of solids flowing through first inlet means 30 and being fed into proportional feeder vessel 2 is illustrated in FIG. 3 having nested conduits 80, 92 and 102. In this embodiment, the conduit adjusting means 66 is attached to the upper end of the outer most conduit 80.

Conduit 80, having a horizontal cross-sectional area greater than that of either conduit 92 or 102, has an upper end 78 and a lower end 84. The upper end 44 of conduit 80 is attached to conduit adjusting means 66. Conduit 80 further comprises an inwardly extending circumferential rib 82 located between its upper end 78 and its lower end 84.

Conduit 92, having a horizontal cross-sectional area less than that of conduit 80, has an upper end 88 and a lower end 90. The upper end 88 of conduit 90 comprises a first outwardly extending circumferential rib portion 106 and a first inwardly extending rib portion 94. Conduit 90 further comprises a second outwardly extending circumferential rib 86 and a second inwardly circumferential rib 110. Both ribs 86 and 110 are located between the upper end 88 and lower end 90 of conduit 92.

Conduit 102, having a horizontal cross-sectional area less than that of either conduit 80 or 92, has an upper end 98 and a lower end 100. Located between the upper end 98 and lower end 100 of conduit 102 is an outwardly extending circumferential rib 96.

A brief description of the operation of the embodiment illustrated in FIG. 3 now follows.

Figure 3C:
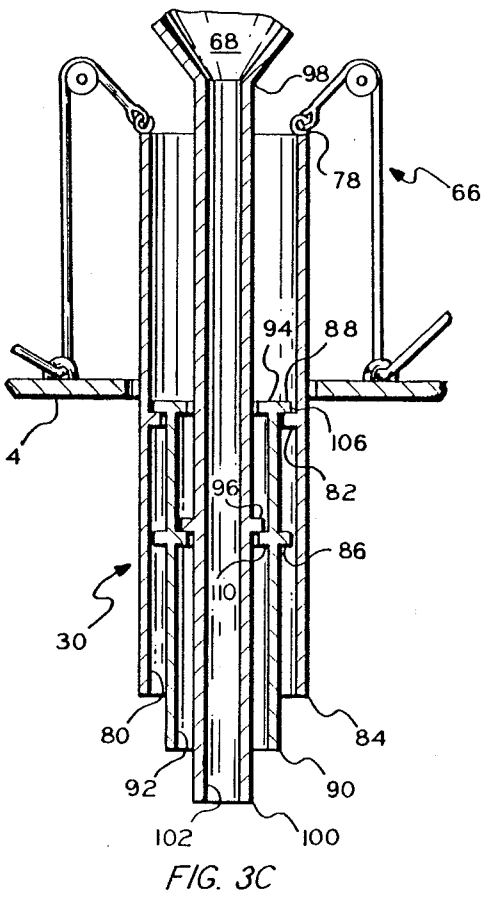
FIGS. 3A, 3B, and 3C are cross-sectional views illustrating a second embodiment of the nested conduits of this invention.
Figure 3B:
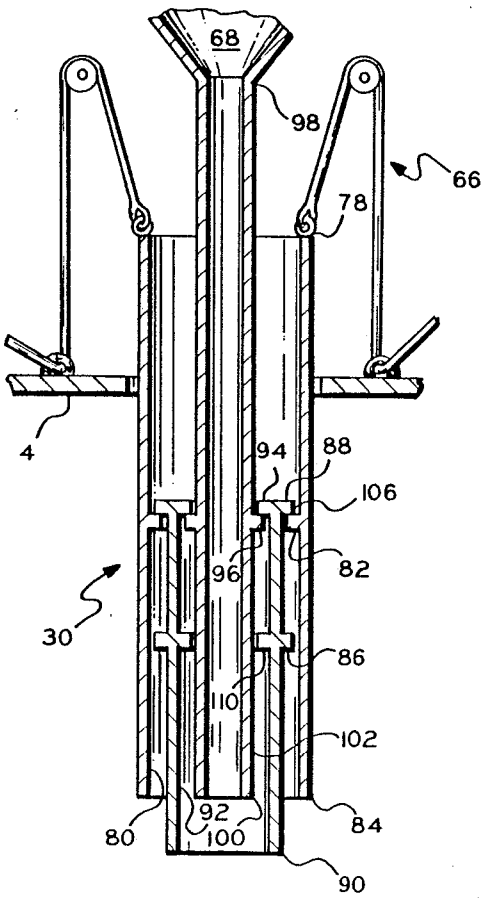
Figure 3A:
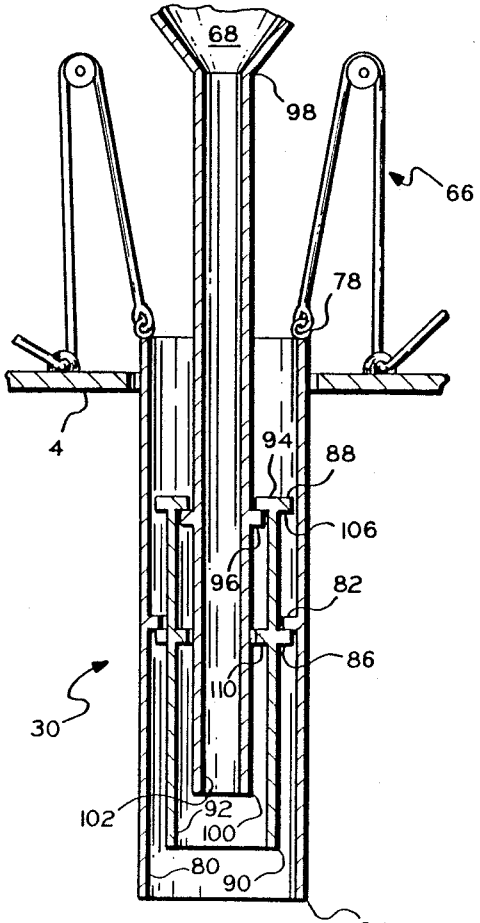

In FIG. 3A, conduit adjusting means 66 is positioned such that conduit 80 is in its lowest most position. When in this position, the lower surface of inwardly extending rib 82 abuts the upper surface of outwardly extending rib portion 86; and, the lower surface of inwardly extending rib portion 94 abuts the upper surface of outwardly extending rib portion 96. When conduit adjusting means 66 lowers conduit 80 to its lowest most position, conduit 80 is the lowest nested conduit. As stated above, conduit 80 has a horizontal cross-sectional area greater than that of either conduit 92 or 102. Therefore, if the nested conduits are positioned as illustrated in FIG. 3A, assuming a constant flow out through outlet means 12, a greater amount of particulate material will enter the vessel through first inlet means 30 than would if the nested conduits were positioned as illustrated in either FIG. 3B or FIG. 3C.

In FIG. 3B, the conduit adjusting means 66 is positioned such that the upper surface of inwardly extending rib 82 of conduit 80 abuts the lower surface of outwardly extending rib portion 106 of conduit 92; and, the lower surface of inwardly extending rib portion 94 rests upon the upper surface of outwardly extending rib 96. When conduit adjusting means 66 elevates conduit 80 to this position, conduit 92 is the lowest nested conduit. As stated above, conduit 92 has a horizontal cross-sectional area greater than that of conduit 102. Therefore, if the nested conduits are positioned as illustrated in FIG. 3B, assuming a constant flow out through outlet means 12, a lesser amount of particulate material will enter the vessel through first inlet means 30 than would if the nested conduits were positioned as illustrated in FIG. 3A.

In FIG. 3C, when the conduit adjusting means is positioned such that the upper surface of inwardly extending rib 82 abuts the lower surface of outwardly extending rib portion 106; and the upper surface of inwardly extending rib 110 abuts the lower surface of outwardly extending rib 96. When conduit adjusting means 66 is in this position, conduit 102 is the lowest nested conduit. As stated above, conduit 102 has a horizontal cross-sectional area less than that of either conduit 92 or 80. Therefore, if the nested conduits are positioned as illustrated in FIG. 3C, assuming a constant flow out through outlet means 12, a lesser amount of particulate material will enter the vessel through first inlet means 30 than would if the nested conduits were positioned as illustrated in either FIG. 3A or FIG. 3B.

As stated earlier, the length of the chamber formed by the vertical housing of the vessel must be of sufficient length such that the downward rate of flow of each material is uniform from the lower end of the lowest nested conduit of first inlet means 30 through a substantial portion of the vertical cavity of vessel 2.

Also, as was stated earlier, this length is generally at least equal to the greatest cross-sectional dimension in any horizontal plane across the proportional feeder vessel. If the invention stated herein is implemented on a commercial level, the vertical chamber of the proportional feeder can be extremely tall. Therefore, in some applications, it may be desirable to decrease the overall height of the proportional blender. If overall height is a problem, certain modifications, known in the art, can be made to vessel 2 to decrease the overall height of the vessel, while maintaining a uniform flow of particulate material passing therethrough.

One method of reducing the overall height of vessel 2 is to affix, in the lower end portion 8 of vessel 2, an optional baffle means. In FIG. 1, an optional baffle means 114 is illustrated. This particular baffle means has a diverging design.

Another method of reducing the overall height of the solids container and improving the operability of this invention, is by reducing friction and static between the particulate material and the walls of the solids container. One method of reducing friction and static is by coating the inner surfaces of the solids container with a suitable low friction material. Examples of such materials include, but are not limited to, polyethylene, poly(arylene sulfide), polytetrafluoroethylene, and the like.

In another aspect of this invention, the proportional feeder can have more than two inlet means (not shown). In yet a further embodiment, two proportional feeders of the type illustrated in FIG. 1 can be provided in series (not shown).

It is evident from the foregoing that various modifications can be made to the embodiments of this invention without departing from the spirit and scope thereof, which will be apparent to those skilled in the art.

Having thus described the invention, it is claimed as follows:

1. Apparatus suitable for use in mixing at least two particulate solid feeds, comprising:

a vessel having an upper end portion, a medial portion, and a lower end portion, wherein said upper end portion and said medial portion form a generally vertical cavity having a sufficient length and shape such that the downward rate of flow of each material is uniform through a substantial portion of the generally vertical cavity formed by said upper end portion and said medial portion of said vessel;

first inlet conduit means extending through said upper end portion of said vessel and terminating within said medial portion of said vessel, said first inlet conduit means comprising at least two nested, generally vertically oriented conduit elements, each having an open lower end with a horizontal cross-sectional area different from the other said at least two conduit elements;

conduit adjusting means operatively connected to said first inlet conduit means for selectively positioning the open lower end of any one of said at least two conduit elements below said open lower end of the other of said at least two conduit elements;

second inlet conduit means opening into said upper end portion of said vessel; and outlet means in said lower end portion of said vessel for passing solids from said vessel therethrough.

2. An apparatus in accordance with claim 1 wherein the length of the generally vertical cavity formed by said upper end portion and said medial portion of said vessel is at least equal to the greatest cross-sectional dimension in any horizontal plane across said vessel.

3. Apparatus in accordance with claim 2 characterized further to include a flow control means operatively related to said outlet means for controlling the flow of solids from said inlet conduit means through said outlet means.

4. Apparatus in accordance with claim 3 characterized further to include a level sensing means operatively interrelated to said first inlet conduit means, said second inlet conduit means, and said flow control means, wherein said level sensing means senses the levels of solids in said first and said second inlet conduit means, compares said sensed levels with a preset level, and actuates said flow control means to maintain the level of solids in said first and said second inlet conduit means above said preset level.

5. Apparatus in accordance with claim 3 wherein said flow control means is a screw conveyor.

6. Apparatus in accordance with claim 1 wherein said upper end portion and said medial portion of said vessel are both in the shape of a generally vertical rectangle.

7. Apparatus in accordance with claim 1 characterized further to include a baffle means disposed within the lower end portion of said vessel above said solids outlet means for dispersing the flow of solids from said vessel into said solids outlet means.

8. Apparatus in accordance with claim 1 wherein said at least two nested, generally vertically oriented conduit elements are in the shape of generally vertical cylinders.

9. Apparatus in accordance with claim 8 wherein said first inlet conduit means comprises three, nested, generally vertically oriented conduit elements.

10. Apparatus in accordance with claim 1 wherein the inside wall surface of said vessel is coated with a low friction material.

11. Apparatus in accordance with claim 10 wherein said low friction material is selected from the group comprising polyethylene, poly(arylene sulfide), and polytetrafluralethylene.

* * * * *